US008773216B2

(12) United States Patent
Dupont et al.

(10) Patent No.: US 8,773,216 B2
(45) Date of Patent: Jul. 8, 2014

(54) SELECTIVITY OF A DUAL COUPLER

(75) Inventors: François Dupont, Tours (FR); Benoît Bonnet, Tours (FR); Sylvain Charley, Mettray (FR)

(73) Assignee: STMicroelectronics (Tours) SAS, Tours (FR)

( * ) Notice: Subject to any disclaimer, the term of this patent is extended or adjusted under 35 U.S.C. 154(b) by 314 days.

(21) Appl. No.: 13/498,115

(22) PCT Filed: Sep. 27, 2010

(86) PCT No.: PCT/FR2010/052019

§ 371 (c)(1),
(2), (4) Date: Apr. 17, 2012

(87) PCT Pub. No.: WO2011/036423

PCT Pub. Date: Mar. 31, 2011

(65) Prior Publication Data

US 2012/0194293 A1 Aug. 2, 2012

(30) Foreign Application Priority Data

Sep. 28, 2009 (FR) ..... 09 56696

(51) Int. Cl.
*H01P 5/18* (2006.01)
*H01P 5/12* (2006.01)

(52) U.S. Cl.
USPC ..... 333/109; 333/110

(58) Field of Classification Search
USPC ..... 333/109, 110, 112, 115, 116, 117, 118, 333/128
See application file for complete search history.

(56) References Cited

U.S. PATENT DOCUMENTS

| | | | | |
|---|---|---|---|---|
| 7,187,910 | B2 * | 3/2007 | Kim et al. | 455/115.3 |
| 8,384,494 | B2 * | 2/2013 | Laporte et al. | 333/110 |
| 2005/0239421 | A1 | 10/2005 | Kim et al. | |
| 2006/0183444 | A1 | 8/2006 | Hur et al. | |

OTHER PUBLICATIONS

International Search Report dated Feb. 11, 2011 from corresponding International Application No. PCT/FR2010/052019.
English language translation of the Written Opinion of International Searching Authority which was posted on Patentscope on Apr. 2, 2012.

* cited by examiner

*Primary Examiner* — Dean O Takaoka
(74) *Attorney, Agent, or Firm* — Wolf, Greenfield & Sacks, P.C.

(57) ABSTRACT

A directional dual distributed coupler including: a first conductive line between first and second ports, intended to convey a signal to be transmitted in a first frequency band; a second conductive line coupled to the first one; a third conductive line between third and fourth ports, intended to convey a signal to be transmitted in a greater frequency band than the first one; a fourth conductive line coupled to the third one; and at least one diplexer connecting, on the side of the second and fourth ports, the respective ends of the second and fourth lines to a fifth port.

31 Claims, 4 Drawing Sheets

SELECTIVITY OF A DUAL COUPLER

CROSS REFERENCE TO RELATED APPLICATIONS

This application is a U.S. National Stage Patent Application based on PCT Application Number PCT/FR2010/052019, filed on Sep. 27, 2009, which application claims the priority benefit of French patent application number 09/56696, filed on Sep. 28, 2009, which applications are hereby incorporated by reference to the maximum extent allowable by law.

BACKGROUND

1. Technical Field

Embodiments generally relate to electronic circuits and, more specifically, to radio frequency couplers. Embodiments more specifically relate to a dual coupler.

2. Discussion of the Related Art

A coupler is generally used to divert part of the power present on a so-called main or primary transmission line, towards another so-called coupled or secondary line, located close to it.

Couplers can be divided into two categories according to whether they are formed of discrete passive components (lumped-element coupler) or of conductive lines which are close to each other to be coupled (distributed coupler). Embodiments relate to the second category of couplers.

In many applications, it is needed to sample part of the power transmitted over a line, for example, to control the power of an amplifier in a transmit circuit, to control the linearity of a transmit amplifier according to the loss due to the reflection of an antenna, to dynamically match an antenna, etc. A coupler is used to sample this information.

A dual coupler shares measurement ports between two transmission lines intended to convey signals in two different frequency bands. Such a sharing is possible in any dual system where the frequency bands are not used simultaneously. Such is generally the case for radio applications (for example, mobile telephony for a dual-, tri-, or quad-band phone, Wi-Fi, etc.). A dual coupler for example enables sharing the same control or amplification circuit for two transmission paths.

However, in a dual coupler, the antennas connected at the output of the two main lines introduce an additional coupling. The greater this coupling (the poorer the isolation between the two antennas), the more the measurement results are distorted. The coupler is then not sufficiently frequency-selective for one path over the other.

US-A-2005/0239421 discloses a directional dual coupler with capacitive compensation. The signal of the secondary lines is drawn through a diplexer. The other ends of the secondary lines are grounded by resistors.

It would be desirable to improve the selectivity of a dual coupler.

It would also be desirable to have a symmetrical arrangement.

SUMMARY

An embodiment aims at preserving the directivity of the coupler.

An embodiment provides a low-bulk solution.

An embodiment provides a symmetrical arrangement.

An embodiment provides a directional dual distributed coupler comprising:

a first conductive line between first and second ports, intended to convey a signal to be transmitted in a first frequency band;

a second conductive line coupled to the first one;

a third conductive line between third and fourth ports, intended to convey a signal to be transmitted in a greater frequency band than the first one;

a fourth conductive line coupled to the third one;

a first diplexer connecting, on the side of the second and fourth ports, the respective ends of the second and fourth lines to a fifth port;

a resistive divider or a second diplexer connecting on the side of the first and third ports, the respective ends of the second and fourth lines to a sixth port.

According to an embodiment, the second and fourth lines are interrupted approximately in the middle, the two intermediate ends being connected to attenuators.

According to an embodiment, the first diplexer is sized to filter the frequencies of the first band between the fourth line and the fifth port and to filter the frequencies of the second band between the second line and the fifth port.

According to an embodiment, the respective ends of the second and fourth lines are connected to the sixth port by the second diplexer, which is sized to filter the frequencies of the first band between the fourth line and the sixth port and to filter the frequencies of the second band between the second line and the sixth port.

According to an embodiment, an attenuator connects, on the side of the first and third ports, the respective ends of the second and fourth lines to a sixth port.

According to an embodiment, a second diplexer connects, on the side of the first and third ports, the respective ends of the second and fourth lines to a sixth port.

According to an embodiment, the diplexer(s) are formed of low-pass and high-pass filters at least of order 2 and, preferably, of order 3.

An embodiment also provides a circuit for transmitting or receiving radio frequency signals, comprising:

at least one amplifier;

at least one coupler; and at least one circuit for measuring information sampled from the fifth or sixth port.

The foregoing objects, features, and advantages will be discussed in detail in the following non-limiting description of specific embodiments in connection with the accompanying drawings.

DETAILED DESCRIPTION

Figure 1:
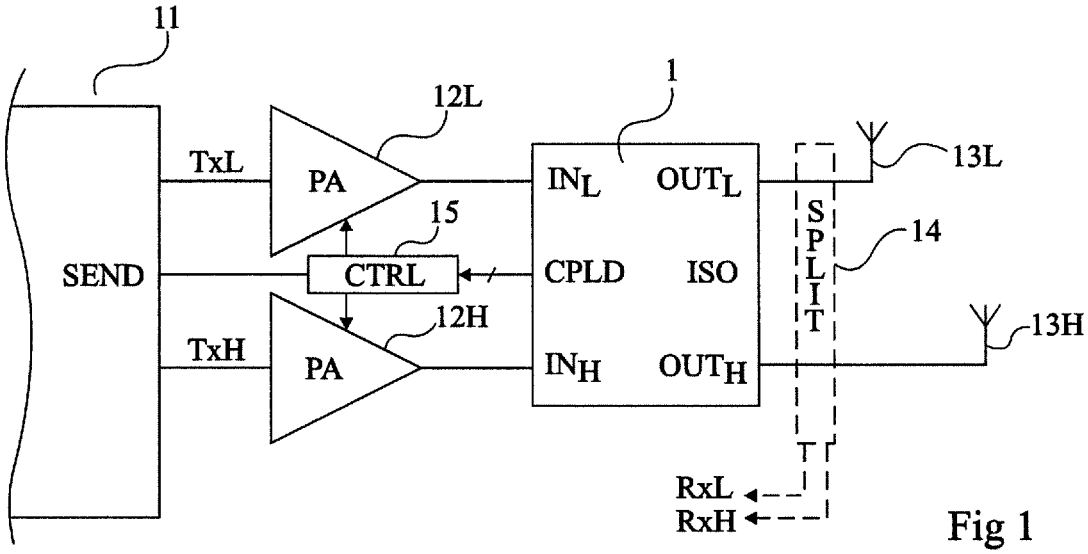
FIG. 1 is an example of an architecture of a dual-path radio frequency transmission chain.

The same elements have been designated with the same reference numerals in the different drawings. For clarity, only those elements which are useful to the understanding of the embodiments have been shown and will be described. In particular, the different possible uses of the signal sampled from the secondary line of the coupler have not been detailed, the embodiments being compatible with any current use.

FIG. 1 is a block diagram of a radio frequency transmission line using a dual coupler.

A transmit circuit 11 (SEND) sends a radio frequency signal to be transmitted. In a dual or multiband system, an amplifier 12L or 12H (PA) is selected according to the frequency band used. In the example of FIG. 1, a first path intended for a frequency band (signal TxL) which is relatively low (with respect to the other band of the system) and using an amplifier 12L (PA), and a second path intended for a frequency band (signal TxH) which is relatively high (greater than the frequencies of the other band) using an amplifier 12H are assumed. The respective outputs of amplifiers 12L and 12H are intended to be connected to antennas 13L and 13H. A coupler 1 is interposed between the respective outputs of amplifiers 12L and 12H and antennas 13L and 13H, possibly with an interposed path splitter 14 (SPLIT) intended to separate the transmit flows from receive flows RxL and RxH intended for receive circuits (not shown).

A first main line of coupler 1 is interposed between the output of amplifier 12L and antenna 13L. A so-called low-frequency input access port $IN_L$ is located on the side of amplifier 12L while a second so-called low-frequency access port $OUT_L$ (sometimes also designated as DIR) is located on the side of antenna 13L. A second main line of coupler 1 is interposed between the output of amplifier 12H and antenna 13H. A so-called high-frequency input access port $IN_H$ is located on the side of amplifier 12H while a so-called high-frequency output access port $OUT_H$ (or $DIR_H$) is located on the side of antenna 13H. One or several coupled or secondary lines of the coupler sample part of the power from the main lines. Measurement ports CPLD and ISO, respectively connected on either side of the secondary line(s) (port CPLD on the side of ports IN and port ISO on the side of ports OUT) provide information about, for example, the power of the transmitted signal, the loss due to the antenna reflection, etc. In the example of FIG. 1, measurements are provided to a circuit 15 (CTRL) to control the gain of the amplifier 12L or 12H used. The fact of using a dual coupler enables same control circuit (or even the same amplifiers) to be shared for several different paths.

A coupler is defined, among others, by its directivity which represents the power difference (expressed in dB) between the two accesses of its coupled or secondary line. An ideal coupler has an infinite directivity, that is, no power is present on port ISO of its secondary line, located in front of output port OUT of its main line, when a signal flows on this main line from the input port to this output port. In practice, a coupler is said to be directional when its directivity is sufficient for the powers recovered from the ports of its secondary line to enable to distinguish the direction of the power flow in the main line.

The embodiments which will be described relate to directional couplers in which the signals present on terminals CPLD and ISO do not have the same levels. If these couplers are symmetrical, they are then bidirectional, that is, just as a signal applied on terminal IN is coupled with terminal CPLD, a signal applied on terminal OUT is coupled at the level of terminal ISO.

Figure 2:
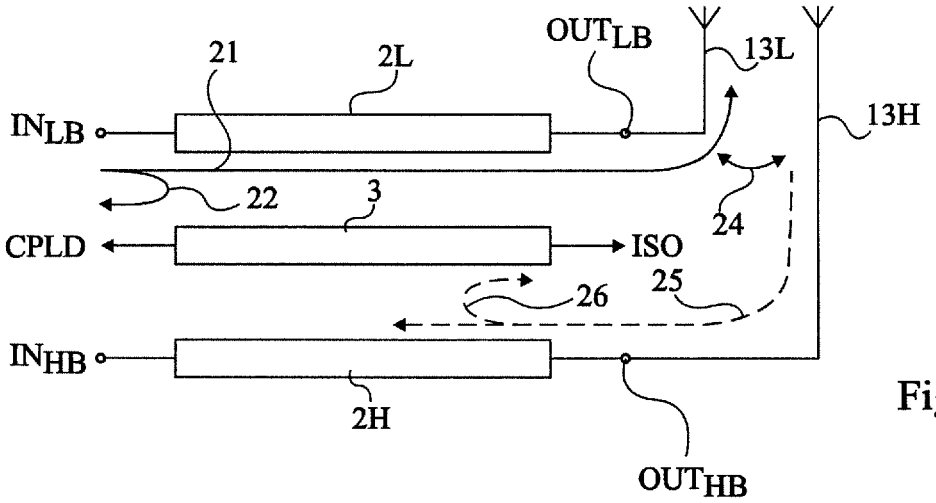
FIG. 2 shows an example of a dual distributed coupler.

FIG. 2 is a simplified view of a dual distributed coupler. A first main line 2L of coupler 1, intended to be interposed on a radio frequency transmission line (low-frequency band), is directly connected to two respective input and output ports or terminals $IN_{LB}$ and $OUT_{LB}$. A second main line 2H, intended to be interposed on another radio frequency transmission line (high-frequency band) is directly connected to two respective input and output ports or terminals $IN_{HB}$ and $OUT_{HB}$. A secondary line 3, for example, interposed between the two main lines, comprises two respective ports or terminals CPLD and ISO, and is indeed to convey information proportional to the power transmitted in the main line used. Lines 2L, 2H, and 3 are, in practice, formed of conductive tracks supported by an insulating substrate. The line lengths depend on the desired operating frequency. To simplify the drawings, lines 2L and 2H have been shown with the same length but in practice have different lengths. The line width depends on the directivity and on the desired characteristic impedance.

The coupler of FIG. 2 is directional, since the signals present on ports CPLD and ISO do not have the same levels. Such a coupler is, however, symmetrical, which makes it bidirectional. In a directional symmetrical coupler such as illustrated in FIG. 2, the functions of the terminals are defined by the connections of the coupler to the other elements.

The main parameters of a coupler are:

the insertion loss, which corresponds to the transmission loss between the two accesses of a main line (the insertion loss is defined while the two other ports of the coupler are loaded with a 50-ohm impedance);

the coupling, which corresponds to the transmission loss between ports IN and CPLD (the coupling is then defined while the two other ports OUT and ISO are loaded with a 50-ohm impedance);

the isolation, which corresponds to the transmission loss between portions IN and ISO (the isolation is defined while the two other ports OUT and CPLD are loaded with a 50-ohm impedance); and the directivity, which corresponds to the difference in transmission loss between ports ISO and CPLD, from port IN.

Assuming that the coupler is driven by a low-frequency signal on terminal $IN_{LB}$, the most part of this signal (arrow 21) is transmitted to antenna 13L. A small part of the signal (with a power depending on the coupling) can be found on terminal CPLD. It is considered that a coupler has a good directivity if the directivity is at least 20 dB. With a coupling of approximately −30 dB (which corresponds to sampling 1/1000 of the transmitted power), the isolation then is on the order of −50 dB, which is acceptable, and a small part of the signal can be found on terminal ISO. Ideally, antenna 13L absorbs the entire signal without generating any reflection. This corresponds to the operation of a simple coupler. In a dual coupler, the isolation between antennas 13L and 13H is not perfect and a coupling (arrow 24) appears between the two antennas. A parasitic signal is then sent back by antenna 13H, intended for high frequencies (arrow 25), to terminal $OUT_{HB}$ of the coupler. Part of this reflected signal is coupled to terminal ISO (arrow 26). This parasitic coupling degrades the coupler performance and above all distorts the measurement on terminal ISO, and thus the measurement of the reflection loss (difference between the powers present on terminals CPLD and ISO).

Figure 3:
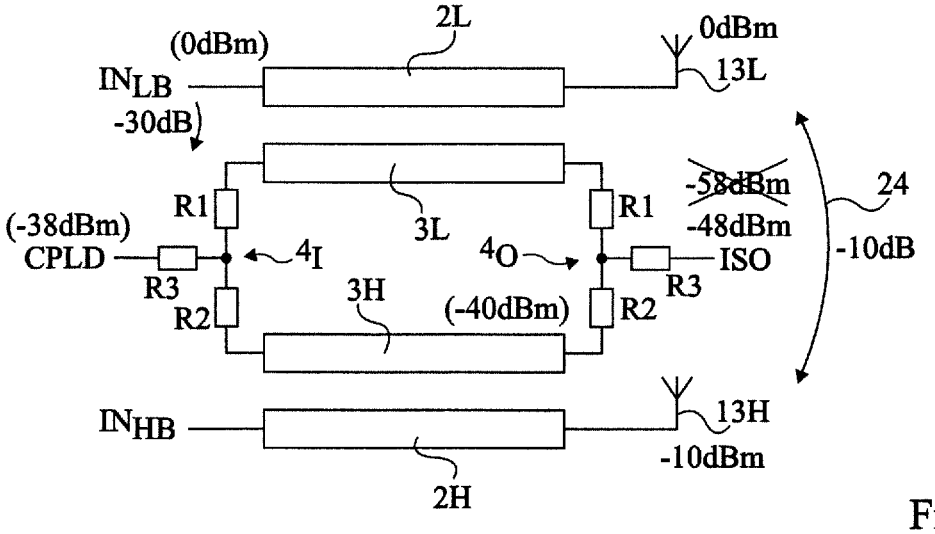
FIG. 3 shows another example of a dual distributed coupler.

FIG. 3 shows another embodiment of a dual coupler equipped with attenuators.

In the example of FIG. 3, conductive tracks 3L and 3H take part in the forming of secondary lines respectively dedicated to main lines 2L and 2H. The respective ends of secondary lines 3L and 3H are, on the side of terminal CPLD, connected by a resistive splitter $\mathbf{4}_I$. These lines are connected, on the side of terminal ISO, by a resistive splitter $\mathbf{4}_O$. Each splitter is formed of three resistors R1, R2, and R3. Two resistors R1 and R2, generally of same value, are in series between the respective ends of lines 3L and 3H ($IN_{LB}$ and $IN_{HB}$ for separator $\mathbf{4}_I$ and $OUT_{LB}$ and $OUT_{HB}$ for separator $\mathbf{4}_O$) and a third resistor R3 connects the midpoint of this series connection to terminal CPLD, respectively ISO.

However, the two splitters alter the coupler directivity in the case of a poor isolation between antennas 13L and 13H. For example, terminal $IN_{LB}$ is assumed to be reached by a signal to be transmitted at 0 dBm and the coupler is assumed to have a 20-dB directivity. With a 30-dB coupling, and assuming that the splitters cause an 8-dB attenuation, −38 dBm can be found on terminal CPLD. It is also assumed that there is no insertion loss. The 0 dBm can be found on the side of antenna 13L (neglecting the insertion loss and the loss due to the coupling). With a 20-dB directivity and a perfect isolation between antennas 13L and 13H, −50 dBm can be found at the end of line 3L, which become −58 dBm on terminal ISO. However, assuming a 10-dB isolation between the two antennas, −10 dBm can be found on antenna 13H, which become −40 dBm by coupling at the end of line 3H on the side of terminal ISO. Accordingly, this coupling translates as a −48-dBm level on terminal ISO instead of the −58 dBm which should be obtained. The obtained result amounts to that which would be provided by a coupler having a 10-dB directivity (very low).

This problem, due to return losses, is not dealt with by US-A-2005/0239421 cited above, which provides a duplexer on the side of the coupled port, and in which the ISO ports of the two secondary line and grounded through a 50 ohms resistor and these ISO ports are connected to the main line by a capacitive element.

Figure 4:
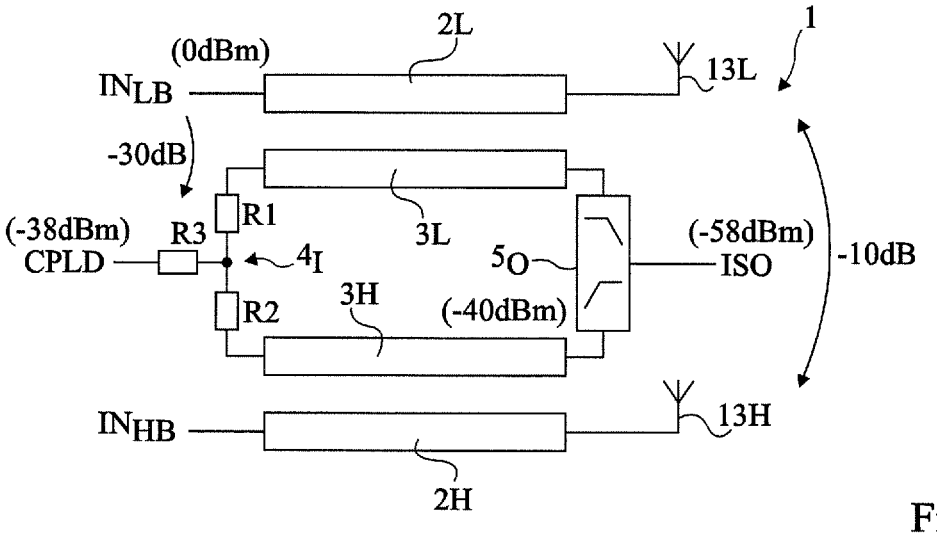
FIG. 4 shows an embodiment of a dual distributed coupler.

FIG. 4 shows an embodiment of a dual coupler 1 preserving the coupler directivity.

According to this embodiment, splitter $\mathbf{4}_O$ on the side of terminal ISO is replaced with a diplexer $\mathbf{5}_O$, that is, a low-pass filter on the side of line 3L associated with a high-pass filter on the side of line 3H. The aim is to filter the signal received by the antenna which is not used in the transmission.

It should be noted that circuit $\mathbf{5}_O$ is a diplexer having the function of separating two frequency bands remote from each other, and not a duplexer having the function of separating transmit paths from receive paths.

It could have been devised to place respectively low-pass and high-pass filters between respective main lines 2L and 3L and their antennas 13L and 13H. However, such filters need to withstand the transmitted power, which requires a significant size. Further, the presence of a filter on the main line introduces an insertion loss which, to be minimized, require inductances with a high quality factor, and thus of significant size.

Figure 5:
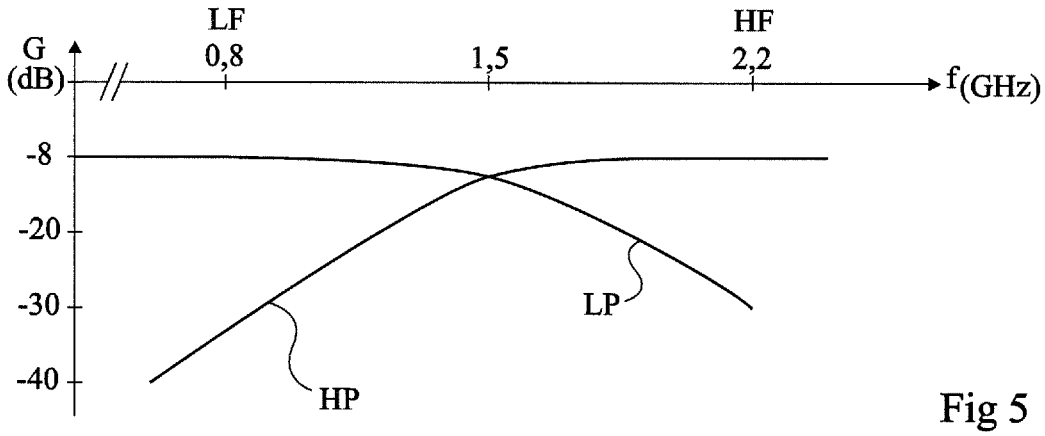
FIG. 5 illustrates the characteristics of a diplexer of the coupler of FIG. 4.

FIG. 5 illustrates an example of a response curve of diplexer $\mathbf{5}_O$ of FIG. 4. A diplexer introducing 8 dB of insertion loss is arbitrarily assumed (to create a balance with splitter $\mathbf{4}_I$ on the side of terminal CPLD, which also introduces an 8-dB attenuation). FIG. 5 illustrates an example of application to mobile telephony in which low frequency band LF is around 800 MHz and high frequency band HF is around 2.2 GHz. Path LP of the diplexer lets through low frequencies, between the end of line 3L and terminal ISO, and cuts off high frequencies, while path HP, between the end of line 3H and terminal ISO, cuts off low frequencies to let through frequencies in the 2.2 MHz band. The numerical example of FIG. 5 is arbitrary and it will be within the abilities of those skilled in the art to adapt diplexer 5 according to the frequency bands to be processed by the coupler.

Taking the example of a signal reaching terminal $IN_{LB}$ at 0 dBm for a coupler having a theoretical 20-dB directivity and a −30-dB coupling, a signal at −38 dBm can be found on terminal CPLD as in the example of FIG. 3. However, on the side of terminal ISO, the signal at −40 dBm originating from antenna 13H and from its 10-dB coupling with antenna 13L is cut off by the high-pass filter. Indeed, the signal is in the low-frequency band. Accordingly, a signal at −58 dBm can effectively be found on terminal ISO.

A similar operation occurs when the coupler is driven over line 2H by a signal in the high-frequency band, the poor isolation between the two antennas being filtered by diplexer 5.

The diplexer is preferably sized to have an attenuation corresponding to that of attenuator $\mathbf{4}_I$ on the side of terminal CPLD.

Figure 6:
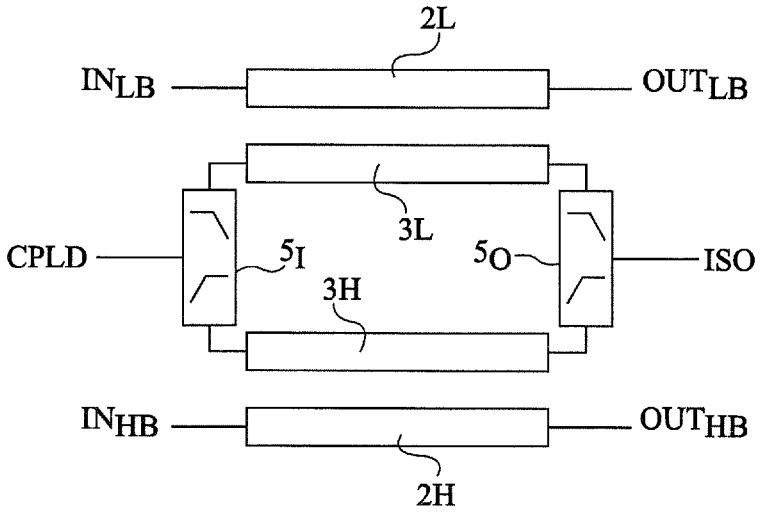
FIG. 6 shows another embodiment of a dual distributed coupler.

FIG. 6 shows another embodiment in which, instead of attenuator $\mathbf{4}_I$, a second diplexer $\mathbf{5}_I$ is provided on the side of terminal CPLD. Such an embodiment makes the coupler symmetrical, and thus bidirectional, conversely to the assembly of FIG. 4 which is not symmetrical.

Figure 7:
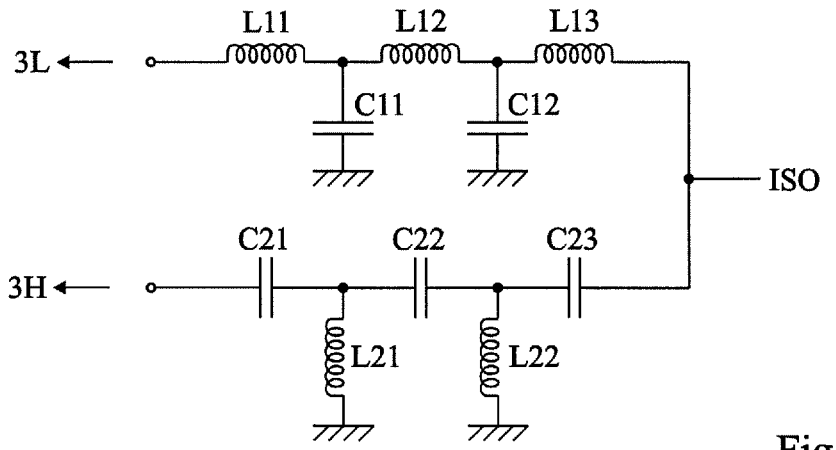
FIG. 7 shows an embodiment of a diplexer of the coupler of FIGS. 4 and 6.

FIG. 7 shows a first embodiment of a diplexer usable in the coupler of FIGS. 4 and 6.

A first branch between terminal ISO and the end of line 3L forms a low-pass filter of order 3. Three inductances L11, L12, and L13 are in series and the midpoints of this series connection are directly grounded by capacitors, respectively C11 and C12.

A second branch between terminal ISO and the end of line 3H forms a high-pass filter of order 3. Three capacitors C21, C22, and C23 are in series and the midpoints of this series connection are directly grounded by inductances, respectively L21 and L22.

Figure 8:
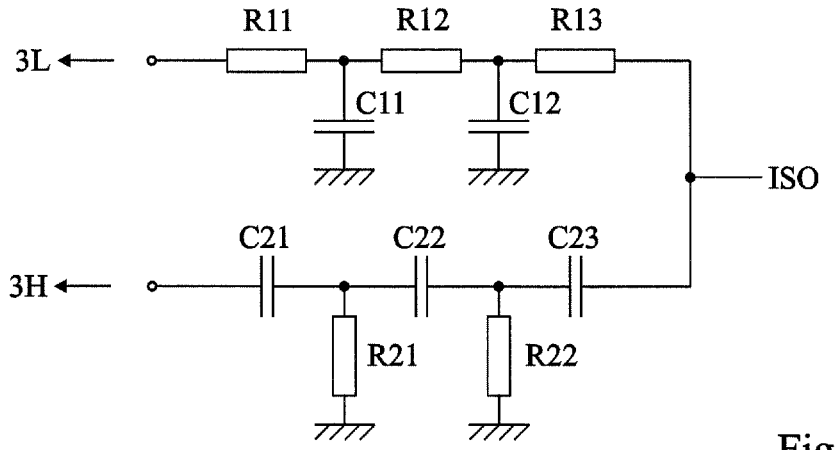
FIG. 8 shows another embodiment of a diplexer of the coupler of FIGS. 4 and 6.

FIG. 8 shows another embodiment of a diplexer usable in the embodiments of FIGS. 4 and 6. As compared with FIG. 7, inductances L11, L12, L13, L21, and L22 are replaced with resistors, respectively R11, R12, R13, R21, and R22.

The selection between a construction based on inductive or resistive elements for example depends on the available technology and, especially, on the possibility of easily integrating inductive elements in this technology. The construction in integrated form of diplexers in the form of resistive and capacitive devices is generally easier.

For selectivity reasons, the low-pass and high-pass filters forming the diplexers are at least of order 2 and, preferably, of order 3.

Figure 9:
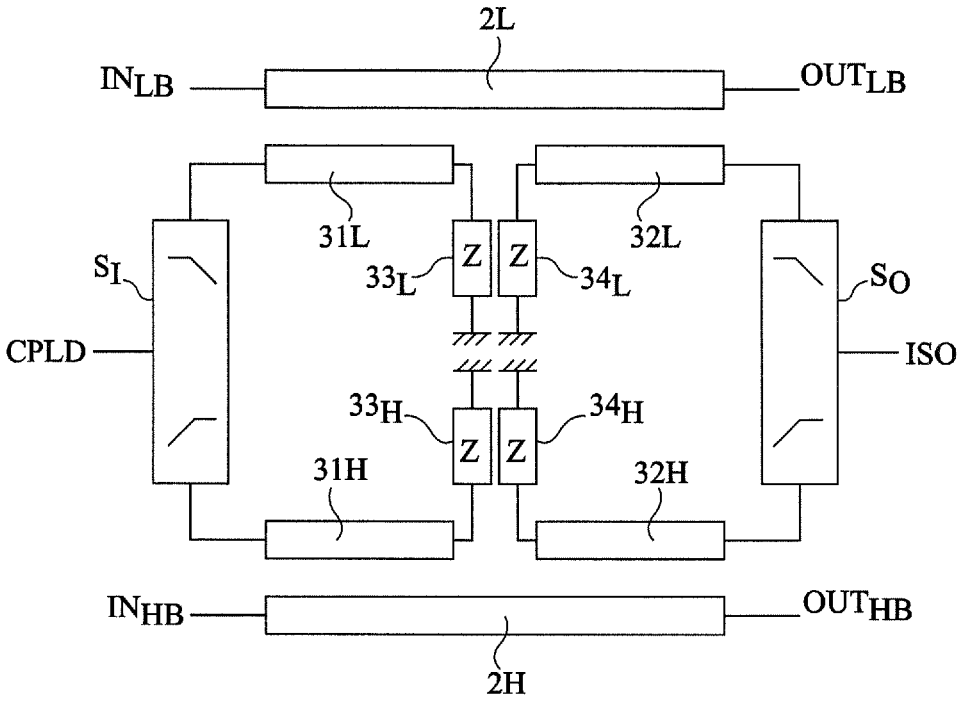
FIG. 9 shows another embodiment of a dual distributed coupler.

FIG. 9 shows a coupler according to another embodiment.

With respect to the embodiment of FIG. 6, each secondary line 3L, 3H is interrupted approximately on its middle to form two parts. The face to face ends of the parts are respectively grounded by a attenuator.

Hence, each secondary line comprises two parts $\mathbf{31}_L$, $\mathbf{32}_L$ and $\mathbf{31}_H$, $\mathbf{32}_H$ parallel to lines $\mathbf{2}_L$ and $\mathbf{2}_H$. Parts 31 et 32 are, preferably symmetrical, i.e. of the same length. Their respective external ends are connected to filters 5. Their respective internal ends are connected to attenuators $\mathbf{32}_L$, $\mathbf{34}_L$ and $\mathbf{33}_H$, $\mathbf{34}_H$.

This coupler structure avoids the influence of charges present on ports CPLD and $ISO_i$. An advantage is that this helps the impedance adaptation and improves the directivity.

Attenuators 33 and 34 are preferably chosen in order to provide attenuation at least equal to half of the coupler directivity.

Figure 10:
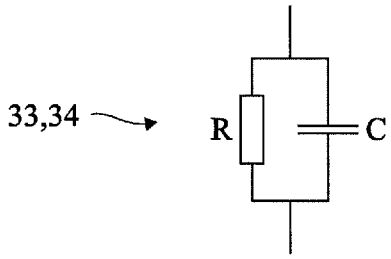
FIG. 10 shows an example of an attenuator of the coupler of FIG. 9.

FIG. 10 shows an example of attenuator 33 or 34. This attenuator is formed by a resistor and a capacitor C in parallel between the internal end of the corresponding part and ground. For example, the resistor has a value of 50 ohms and the capacitor has a value of the magnitude of a picofarad.

Figure 11:
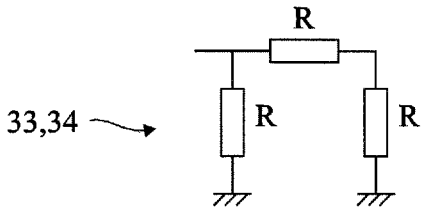
FIG. 11 shows another example of an attenuator of the coupler of FIG. 4.

FIG. 11 shows another example of attenuator 33 or 34. This attenuator is formed by three pi-connected resistors R between the internal end of the corresponding part and ground. With such attenuators, each semi-coupler corresponds to the coupler disclosed in French patent application 2 923 940 (B8533-07-TO-295-296) or in US patent application 2009/0128255.

One could also provide T-attenuators or attenuators having other forms.

Attenuators 33 and 34 are preferably chosen to provide attenuation at least equal to half of the coupler directivity.

It is now possible to form a dual coupler which is frequency-selective while remaining of small size. Indeed, diplexers on coupled lines only see a low power.

Specific embodiments of the present invention have been described. Various alterations and modifications will occur to those skilled in the art. In particular, the dimensions of the lines according to the frequency bands desired for the coupler can be determined by those skilled in the art by using current methods. Further, the dimensions of the components, of the diplexers and attenuators, can also be determined by those skilled in the art according to the desired attenuation. Further, although the present invention has been described in relation with a radio frequency transmission chain, it easily transposes to a receive chain.

Such alterations, modifications, and improvements are intended to be part of this disclosure, and are intended to be within the spirit and the scope of the present invention. Accordingly, the foregoing description is by way of example only and is not intended to be limiting. The present invention is limited only as defined in the following claims and the equivalents thereto.

What is claimed is:

1. A directional dual distributed coupler comprising:

a first conductive line between first and second ports, the first line configured to convey a signal transmitted in a first frequency band;

a second conductive line coupled to the first line;

a third conductive line between third and fourth ports, the third line configured to convey a signal transmitted in a second frequency band than the first frequency band;

a fourth conductive line coupled to the third line;

a first diplexer connecting, on a side of the second and fourth ports, first respective ends of the second and fourth lines to a fifth port; and a resistive divider or a second diplexer connecting, on a side of the first and third ports, second respective ends of the second and fourth lines to a sixth port.

2. The coupler of claim 1, wherein:

the second line is interrupted approximately in the middle of the second line, two intermediate ends of the interrupted second line being connected to respective attenuators, and the fourth line is interrupted approximately in the middle of the fourth line, two intermediate ends of the interrupted fourth conductive line being connected to respective attenuators.

3. The coupler of claim 1, wherein the first diplexer is sized to filter the frequencies of the first band between the fourth line and the fifth port, and to filter the frequencies of the second band between the second line and the fifth port.

4. The coupler of claim 1, wherein the second respective ends of the second and fourth lines are connected to the sixth port by the second diplexer, the second diplexer being sized to filter the frequencies of the first band between the fourth line and the sixth port and to filter the frequencies of the second band between the second line and the sixth port.

5. The coupler of claim 1, wherein the first diplexer is formed of a low-pass filter of at least order 2 and a high-pass filter of at least order 2.

6. A circuit for transmitting or receiving radio frequency signals, comprising:

at least one amplifier;

at least one coupler according to claim 1; and at least one circuit for measuring information sampled from the fifth or sixth port.

7. The coupler of claim 5, wherein the low-pass filter is of order 3 and/or the high-pass filter is of order 3.

8. The coupler of claim 4, wherein the second diplexer is formed of a low-pass filter of at least order 2 and a high-pass filter of at least order 2.

9. The coupler of claim 8, wherein the low-pass filter is of order 3 and/or the high-pass filter is of order 3.

10. A directional coupler comprising:

secondary conductive lines configured to couple to respective primary conductive lines configured to couple to respective antennas;

a coupled port coupled to the secondary conductive lines through respective first portions of the secondary conductive lines and configured to provide power at a first level in response to a first of the primary conductive lines carrying a signal;

an isolation port coupled to the secondary conductive lines through respective second portions of the secondary conductive lines and configured to provide power at a second level lower than the first power level at the coupled port in response to the first of the primary conductive lines carrying the signal; and a diplexer configured to couple the second portions of the secondary conductive lines to the isolation port.

11. The directional coupler of claim 10, wherein the diplexer comprises filters coupled between the respective second portions of the secondary conductive lines and the isolation port.

12. The directional coupler of claim 11, wherein the first primary conductive line is configured to carry a signal in a first frequency band, wherein a first of the secondary conductive lines is configured to couple to the first primary conductive line, wherein a first of the filters is coupled to the first secondary conductive line, and wherein the first filter is configured to filter signals having frequencies outside the first frequency band.

13. The directional coupler of claim 12, wherein a second of the primary conductive lines is configured to carry a signal in a second frequency band, wherein a second of the secondary conductive lines is configured to couple to the second primary conductive line, wherein a second of the filters is coupled to the second secondary conductive line, and wherein the second filter is configured to filter signals having frequencies outside the second frequency band.

14. The directional coupler of claim 11, wherein the first primary conductive line is configured to carry a first signal, wherein a first of the secondary conductive lines is configured to sample a first portion of the first signal via a coupling between the first primary conductive line and the first secondary conductive line, wherein a second of the secondary conductive lines is configured to sample a second portion of the first signal via a coupling between the second secondary conductive line and the first primary conductive line, wherein a second of the filters is coupled to the second secondary conductive line, and wherein the second filter is configured to filter the second portion of the first signal.

15. The directional coupler of claim 14, wherein the first primary conductive line is coupled to a first of the antennas, wherein a second of the primary conductive lines is coupled to a second of the antennas, and wherein the coupling between the second secondary conductive line and the first primary conductive line comprises a parasitic coupling between the first and second antennas.

16. The directional coupler of claim 14, wherein a second of the primary conductive lines is configured to carry a second signal, wherein the second secondary conductive line is configured to sample a first portion of the second signal via a coupling between the second primary conductive line and the second secondary conductive line, wherein the first secondary conductive line is configured to sample a second portion of the second signal via a coupling between the first secondary conductive line and the second primary conductive line, wherein a first of the filters is coupled to the first secondary conductive line, and wherein the first filter is configured to filter the second portion of the second signal.

17. The directional coupler of claim 16, wherein the second primary conductive line is coupled to a second of the antennas, wherein the first primary conductive line is coupled to a second of the antennas, and wherein the coupling between the first secondary conductive line and the second primary conductive line comprises a parasitic coupling between the first and second antennas.

18. The directional coupler of claim 11, wherein at least one of the filters comprises a filter of at least order 2.

19. The directional coupler of claim 18, wherein at least one of the filters comprises a third-order filter.

20. The directional coupler of claim 10, wherein the coupler is symmetrical and/or bidirectional.

21. The directional coupler of claim 10, wherein the diplexer is a first diplexer, and wherein the coupler further comprises a second diplexer configured to couple the first portions of the secondary conductive lines to the coupled port.

22. The directional coupler of claim 10, further comprising a resistive splitter configured to couple the first portions of the secondary conductive lines to the coupled port.

23. The directional coupler of claim 22, wherein the resistive splitter is configured as an attenuator.

24. The directional coupler of claim 10, wherein at least one of the secondary conductive lines comprises a first part coupled to ground through a first attenuator and a second part coupled to ground through a second attenuator.

25. The directional coupler of claim 24, wherein the first attenuator comprises at least one resistive component in parallel with at least one capacitive component.

26. The directional coupler of claim 24, wherein the first attenuator comprises a first resistive component coupled between the first part and ground, and second and third resistive components coupled in series between the first part and ground.

27. The directional coupler of claim 10, wherein the first portions of the respective secondary lines are coupled to the isolation port through, respectively, the second portions of the respective secondary lines.

28. The directional coupler of claim 10, wherein the second power level provided at the isolation port is at least 20 dB lower than the first power level provided at the coupled port.

29. A communication device comprising:

amplifiers and antennas, wherein respective inputs of the amplifiers are coupled to respective transmission lines, and wherein respective outputs of the amplifiers are coupled to the respective antennas by respective primary conductive lines;

a directional coupler, comprising:

secondary conductive lines configured to couple to the respective primary conductive lines, a coupled port coupled to the secondary conductive lines through respective first portions of the secondary conductive lines and configured to provide power at a first level in response to a first of the primary conductive lines carrying a signal, an isolation port coupled to the secondary conductive lines through respective second portions of the secondary conductive lines and configured to provide power at a second level lower than the first power level at the coupled port in response to the first of the primary conductive lines carrying the signal, and a diplexer configured to couple the second portions of the secondary conductive lines to the isolation port; and a controller configured to control the amplifiers based, at least in part, on respective signals provided at the coupled port and the isolation port.

30. The communication device of claim 29, wherein the controller is configured to control the power level and/or the linearity of at least one the amplifiers.

31. The communication device of claim 29, further comprising a path splitter coupled between the antennas and the respective primary conductive line, wherein the path splitter is configured to separate signals to be transmitted by the antennas from signals received by the antennas.

* * * * *